US006932495B2

(12) United States Patent
Sloan et al.

(10) Patent No.: US 6,932,495 B2
(45) Date of Patent: Aug. 23, 2005

(54) CHANNEL LETTER LIGHTING USING LIGHT EMITTING DIODES

(75) Inventors: Thomas C. Sloan, Santa Barbara, CA (US); Bruce Quaal, Ventura, CA (US)

(73) Assignee: Sloanled, Inc., Ventura, CA (US)

( * ) Notice: Subject to any disclaimer, the term of this patent is extended or adjusted under 35 U.S.C. 154(b) by 0 days.

(21) Appl. No.: 10/260,246

(22) Filed: Sep. 30, 2002

(65) Prior Publication Data

US 2003/0063463 A1 Apr. 3, 2003

Related U.S. Application Data

(60) Provisional application No. 60/326,276, filed on Oct. 1, 2001.

(51) Int. Cl.[7] ..... F21V 29/00

(52) U.S. Cl. ..... 362/294; 362/231; 362/249; 362/800; 362/812; 40/544; 40/550

(58) Field of Search ..... 362/218, 231, 362/249, 252, 294, 373, 545, 800, 812, 219; 40/544, 550, 551

(56) References Cited

U.S. PATENT DOCUMENTS

| | | | | |
|---|---|---|---|---|
| 5,278,432 A | * | 1/1994 | Ignatius et al. | 362/800 |
| 5,299,109 A | | 3/1994 | Grondal | 362/241 |
| 5,404,282 A | | 4/1995 | Klinke et al. | 362/249 |
| 5,450,301 A | | 9/1995 | Waltz et al. | 362/231 |
| 5,640,792 A | | 6/1997 | Smith et al. | 40/546 |
| 5,660,461 A | | 8/1997 | Ignatius et al. | 362/241 |
| 5,697,175 A | | 12/1997 | Schwartz | 40/552 |
| 5,729,925 A | | 3/1998 | Prothero | 40/570 |
| 5,808,592 A | | 9/1998 | Mizutani et al. | 345/83 |
| 5,927,845 A | | 7/1999 | Gustafson et al. | 362/152 |
| 5,931,577 A | | 8/1999 | Ishibashi | 362/800 |
| 5,949,347 A | | 9/1999 | Wu | 340/815.45 |
| 5,954,423 A | | 9/1999 | Logan et al. | 362/235 |
| 6,042,248 A | | 3/2000 | Hannah et al. | 362/252 |
| 6,065,854 A | | 5/2000 | West et al. | 362/249 |
| 6,283,612 B1 | * | 9/2001 | Hunter | 362/249 |
| 6,394,626 B1 | | 5/2002 | McColloch | 362/251 |
| 6,578,986 B2 | * | 6/2003 | Swaris et al. | 362/294 |
| 6,612,717 B2 | * | 9/2003 | Yen | 362/219 |
| 2002/0159257 A1 | * | 10/2002 | Grajcar | 362/231 |

OTHER PUBLICATIONS

Lumleds, "Red Super Flux LED Rail" Data Sheet, ELCR–KS99–R0100, HLCR–KS99–R0200, p. 9–11.

Gelcore Data Sheet, "GE LED System for Channel Letter Illumination", Jul. 2, 2001.

GE Lighting Product News, "Gelcore LED Channel Letters".

* cited by examiner

*Primary Examiner*—Stephen F Husar

(74) *Attorney, Agent, or Firm*—Koppel, Jacobs, Patrick & Heybl

(57) ABSTRACT

A channel letter lighting unit according to the present invention comprises a printed circuit board (PCB) having a plurality of linearly mounted light emitting elements. Input wires transmit a power signal to the PCB to illuminate the plurality of light emitting elements, and output wires transmit the power signal from the PCB. The PCB is mounted in the extrusion and the light emitting elements transmit light away from the extrusion. The extrusion promotes the dissipation of heat from the light emitting elements. A mounting mechanism is included for mounting the extrusion within a housing. A further embodiment according to the invention comprises a plurality of channel lighting units electrically connected to one another so that a power signal applied to the lighting system is transmitted to each of the plurality of lighting units. A still further embodiment according to the invention comprises an illuminated channel letter system having a housing in the shape of a letter. A translucent lens is included over the housing to transmit light from within the housing. A plurality of channel lighting units are mounted within the housing and coupled to one another in a daisy chain. A power signal applied to the first of the plurality of lighting units in the daisy chain is transmitted to the remaining of the plurality of lighting units.

26 Claims, 7 Drawing Sheets

140
147b
144a
147c
144b
145a
145b
146a
146b
147a
147d
142
141
148d
148c
143
148b
148a
110
112
114
111
115a
115b
118a
118b
117a
117b
119a
119b
119c
119d

CHANNEL LETTER LIGHTING USING LIGHT EMITTING DIODES

This application claims the benefit of provisional application Ser. No. 60/326,276 to Sloan et al., which was filed on Oct. 1, 2001.

BACKGROUND OF THE INVENTION

1. Field of the Invention

This invention relates to lighting units using light emitting diodes (LEDs) and more particularly to LED based lighting units for illuminating channel letters.

2. Description of the Related Art

Recent developments in LEDs have resulted in devices that are brighter, more efficient and more reliable. LEDs are rugged, consume less power, have a relatively long life (up to 100,000 hours), operate at low voltage (7V), and are 30 to 70% more energy efficient than conventional lights, such as neon or fluorescent bulbs.

Channel letters are commonly found on the outside of buildings and are often used to advertise the name of the business. They are typically constructed of an aluminum or plastic housing that is in the shape of a letter and is approximately 5" deep. The housing has a generally U-shaped cross-section, with the opening in the housing covered by a colored plastic translucent lens that transmits light from within the housing.

Channel letters are typically illuminated with neon or fluorescent light sources that are mounted within the channel letter housing. Neon and fluorescent lights provide a bright and continuous light source that allows the channel letters to be visible at night. However, these light sources have a relatively short life (20,000 hours), are fragile, operate at high voltage (7,000 to 15,000 volts for neon) and can consume a relatively large amount of power. Neon bulbs can also experience difficulty with cold starting, which can lead to the bulb's failure.

LEDs have more recently been used as the light source in different applications. U.S. Pat. No. 5,697,175, to Schwartz, discloses a low power illuminated sign that is particularly adapted for use with common EXIT signs over doorways. The back of each sign comprises a reflector with a series of cavities with curved surfaces. Each cavity corresponds to a letter and background area in the sign. LEDs are mounted in the center of the cavities to illuminate the letters or background area. The LEDs are provided on a separate perpendicular circuit board or on a central projection formed in the bottom of the cavities, with light from the LEDS directed outward. The letters and background area of the sign are illuminated by light reflecting forward from the curved surfaces of the cavities, so that the only visible light is from the illumination of the cavities.

The Shwartz lighting arrangement is not compatible with channel letters because the channel letter housing does not have curved surfaces to reflect light forward. Further the Shwartz arrangement can be prohibitively complex and costly for channel letters and the system provides no mechanism for dissipating heat in from the LEDs.

U.S. Pat. No. 6,042,248, to Hannah et al., discloses an LED assembly for channel letter illuminating signs having an enclosure/housing covered by a translucent lens. Each sign includes a plurality of track moldings at the base of its enclosure, with the moldings running along the longitudinal axis of the sections of the channel letter. Linear arrays of LEDs are mounted on printed circuit boards (PCBs) that are mounted in the track moldings. Each track molding can hold two PCBs in parallel with each of the PCBs arranged on a longitudinal edge, with the LEDs directed outward.

One disadvantage of the Hannah arrangement is that it is not flexible enough to be easily mounted to curved sections of channel letters. The process of mounting moldings to the channel letters can also be complicated and time consuming. This arrangement also utilizes two continuous LED linear arrays to illuminate the sections of channel letters along with a molding, which can be prohibitively complex and expensive.

LED based channel letter lighting is also available from LumiLEDs, Inc., under part numbers HLCR-KR-R0100 and HLCR-KR99-R0200, which comprises LEDs that are each mounted by insulation displacement connectors (IDC) on two inch centers. The chain of LED modules is then mounted into a bendable clip or rail, each of which are then mounted inside a channel letter to hold the LEDs in place. Power is provided by a combination of an AC/DC mother power supply and a DC/DC daughter power supply. A sensing LED is also included as a temperature and current sensor.

One disadvantage of this channel lighting arrangement is that it is difficult to install because each of the modules must be individually mounted on the wires using an IDC. They must then be mounted in the channel letter using custom installation tool. The modules do not include structures to help dissipate heat and faulty modules are difficult to remove and replace. The system uses six modules per foot and the power supply is complex and expensive. This system can be prohibitively expensive for many applications.

SUMMARY OF THE INVENTION

One embodiment of a channel letter lighting unit according to the present invention comprises a printed circuit board (PCB) having a plurality of linearly mounted light emitting elements. Input wires transmit a power signal to the PCB to illuminate the plurality of light emitting elements, and output wires transmit the power signal from the PCB. An extrusion is included with the PCB mounted to the extrusion with the light emitting elements transmitting light away from the extrusion. The extrusion promotes the dissipation of heat from the light emitting elements. A mounting mechanism is included for mounting the extrusion within a housing.

A further embodiment according to the invention comprises a plurality of lighting units electrically connected to one another so that a power signal applied to the lighting system is transmitted to each of the plurality of lighting units. Each of the lighting units comprises a plurality of linearly mounted light emitting elements. Input wires transmit the power signal and illuminates the plurality of light emitting elements and the input wires are capable of receiving the power signal from another of the plurality of lighting elements. Output wires transmit the power signal from the PCB and the output wires are capable of transmitting the power signal to another of the plurality of lighting units. An extrusion is included, with the light emitting elements mounted to the extrusion, with the light emitting elements transmitting light away from the extrusion. The extrusion also promoting dissipation of heat from said light emitting elements. A mounting mechanism is also included on each of the lighting units for mounting the extrusion within a housing.

A still further embodiment according to the invention comprises an illuminated channel letter system having a housing in the shape of a letter. A translucent lens is included over the housing to transmit light from within the housing. A plurality of channel lighting units are mounted within the housing and coupled to one another in a daisy chain. A power signal applied to the first of the plurality of lighting units in the daisy chain is transmitted to the remaining of the plurality of lighting units. Each of the plurality of lighting units comprises an extrusion with one or more light emitting elements. The extrusion is capable of dissipating at least some of the heat from the light emitting elements. A mechanism is included for mounting each extrusion within the channel letter housing, the light from the one or more light emitting elements transmitted through the translucent lens.

Lighting unit sand lighting systems according to the present invention are simple, cost effective and easy to use. The extrusion in the lighting units dissipate heat to that the LEDs can operate at a lower temperature. The lighting systems are flexible and can be branched during installation or terminated at any point. Connections between adjacent lighting units are positive lock and can be reused to allow the lighting units to be reused. The lighting units are waterproof with a sealed conformal coating over the PCB.

These and other further features and advantages of the invention will be apparent to those skilled in the art from the following detailed description, taken together with the accompanying drawings, in which:

DETAILED DESCRIPTION OF THE INVENTION

Figure 2:
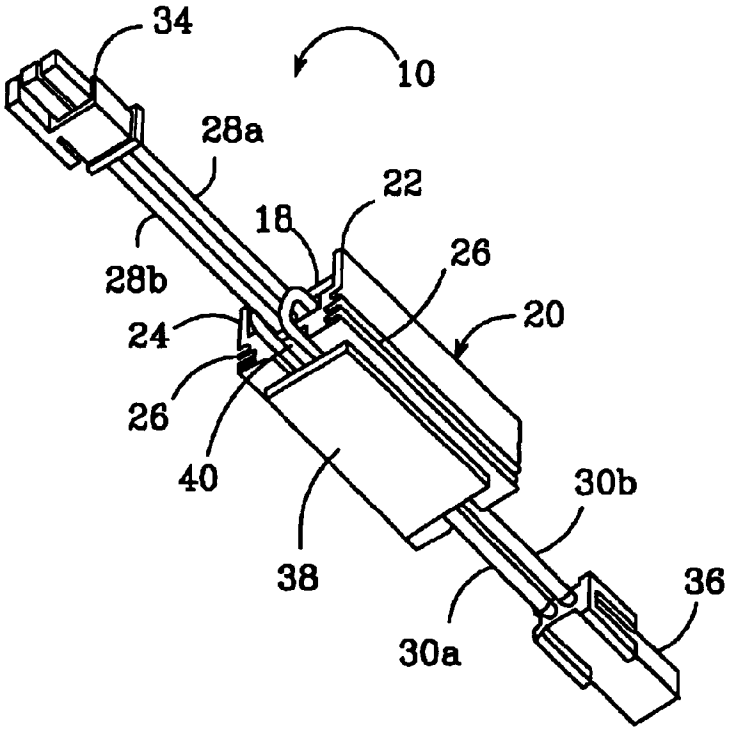
FIG. 2 is a below perspective view of the channel lighting unit in FIG. 1.
Figure 1:
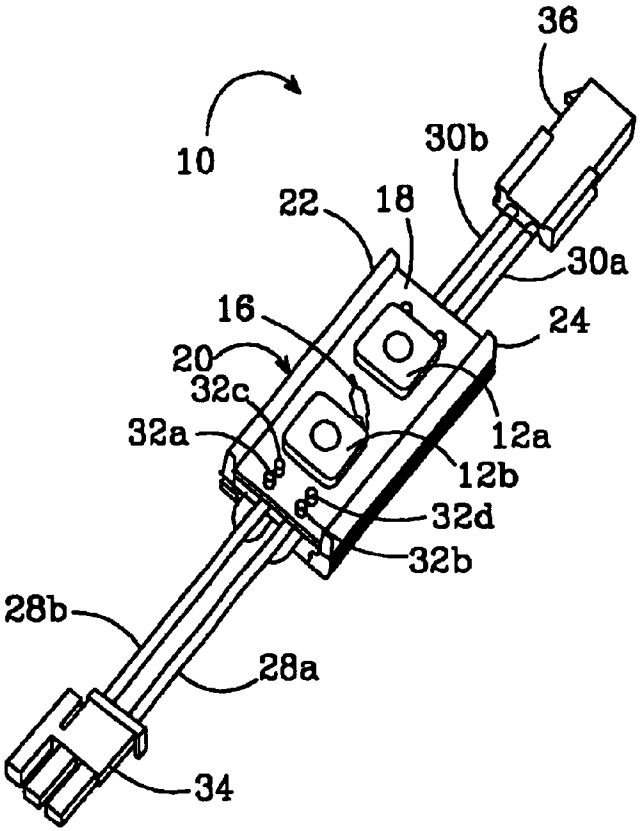
FIG. 1 is an above perspective view of an embodiment of a channel lighting unit in accordance with the present invention.

FIGS. 1 and 2 show one embodiment of the channel lighting unit 10 constructed in accordance with the present invention. It includes two LEDs 12*a*, 12*b* and a series resister 16 that are mounted to a PCB 18 by conventional methods. The PCB 18 could have a different number of LEDs and other passive components and the LEDs can emit the same or different colors of light. In one embodiment of the unit 10 the LEDs 12*a*, 12*b* emit red light. The LEDs 12*a* and 12*b* provide high luminous flux and have a wide viewing angle.

The PCB 18 has conventional interconnecting conductive traces (not shown) to provide the interconnections between the LEDs 12*a*, 12*b* and the resister 16. The PCB 18 is mounted within an extrusion 20, which can be made of many different thermally conductive materials such as aluminum. The PCB 18 is mounted on the extrusion 20 closely between two vertical strips 22, 24 that run along the longitudinal edges of the PCB 18. The strips 22, 24, provide some protection for the LEDs 12*a*, 12*b*, the series resister 16 and the PCB 18 by extending above the PCB 18 and providing a hard surface covering the edges of the PCB 18. The extrusion also has horizontal fins 26 that run longitudinally down the extrusion 20, below the PCB 18. The PCB's LEDs can heat during operation and the heat radiates into the extrusion 20. The fins 26 help dissipate heat into the ambient by providing a larger surface to radiate the heat.

Input wires 28*a*, 28*b* are connected to the PCB 18 at connection points 32*a*, 32*b* and output wires 30*a*, 30*b* are connected at connection points 32*c*, 32*d*. The input wires 28*a*, 28*b* have a "male" connector 34 at their end opposite the PCB 18 and the output wires 30*a*, 30*b* have a "female connector" 36 at their end opposite the PCB 18. The connectors 34 and 36 positive lock, reusable connectors that are known in the industry. They provide a reliable means of connecting the lighting units in a daisy chain. "Y" connectors or the like (described below), can be used to branch from the daisy chain to match the shape of the channel letter. High bond double-sided tape 38 is used to mount the lighting unit 10 to the channel letter, although other mounting methods can be used such as screws, clips or clamps. One side of the tape 38 is mounted to the extrusion 20 and the other side mounts the extrusion 20 to the interior of a channel letter housing.

The PCB 18 can be mounted within the extrusion 20 by many different methods and using many different materials. A preferred method is bonding using a thermally conductive carbon filled epoxy to help transfer heat from the LEDs 12*a*, 12*b* to the extrusion 20. This heat transfer along with the dissipation of the extrusion 20 and its fins 26 allows the LEDs 12*a*, 12*b* to operate at a lower temperature. This in turn allows them to burn brighter and hotter, and last longer. The LEDs 12*a*, 12*b*, PCB 18 and extrusion 20 combination bonded together provides a rugged and easy to install channel lighting package.

Figure 3:
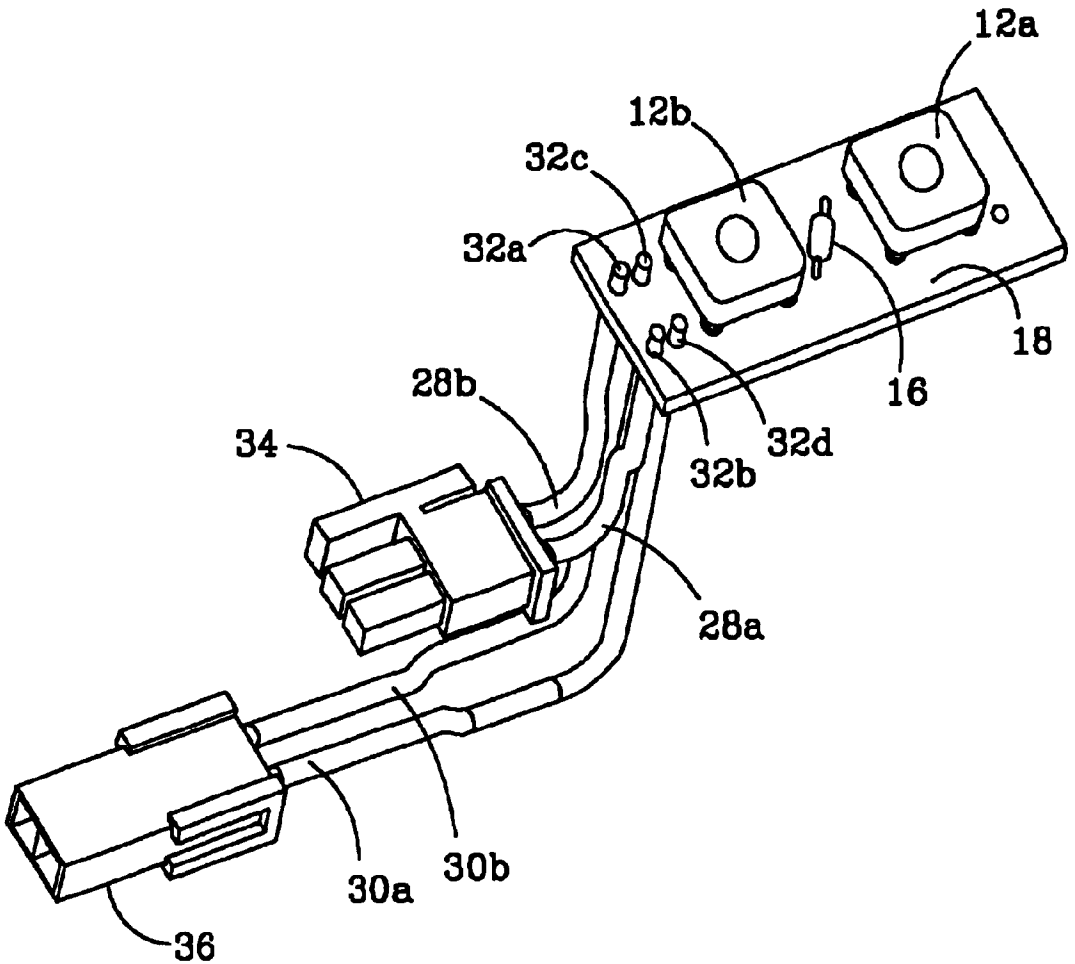
FIG. 3 is a perspective view of the LEDs, PCB, input and output wires of the channel lighting unit of FIG. 1.

FIG. 3 shows the PCB 18 removed from the extrusion, with the LEDs 12,14 and series resister 16 mounted to the PCB 18. The input wires 28*a* and 28*b* are connected to the PCB 18 at input connector points 32*a* and 32*b* and the output wires 30 are connected to the PCB at adjacent output connection points 32*c* and 32*d*. By having the input and output wires 28*a*, 28*b* and 30*a*, 30*b* connected to adjacent connection points the signal applied at the input connection points 32*a*, 32*b* can be directly transmitted to the output connection points without the signal first being transmitted through the components on the PCB. This reduces the line loss, and the resulting loss in brightness that can be experienced in daisy-chained units 10 that are connected down the line from the power supply. In other embodiments, the input and output connection points can be at opposite ends of the PCB. Conductive traces on the PCB 18 conduct the voltage from the input connection points 32*a*, 32*b* to the LEDs 12, 14 and their series resister 16.

Referring again to FIG. 2, when the PCB 18 is bonded to the extrusion 20 the output wires 30*a* and 32*b* are folded under the extrusion 20 and housed within the extrusion's bottom longitudinal cavity 40. The double-sided tape 38 covers the longitudinal cavity 40 and holds the output wires within the cavity 40. The input and output wires 28 and 30 extend from opposite ends of the PCB/extrusion assembly, and their respective connectors 34 and 36 face in opposite directions. This arrangement makes the units 10 particularly adapted for easy assembly in a daisy chain.

Figure 4:
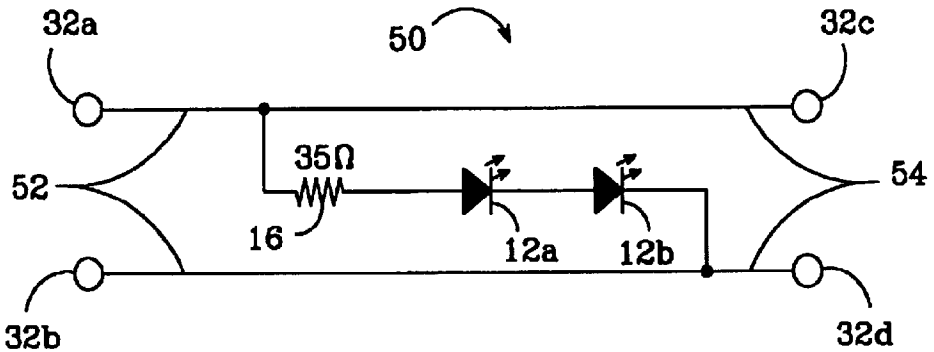
FIG. 4 is a diagram of the interconnections between the LEDs and series resister.

FIG. 4 shows one embodiment 50 of the interconnections between the LEDs 12*a*, 12*b* and the series resister 16. Approximately 7.5 volts is provided to connection points 32*a*, 32*b* from a standard regulated power supply. The input 52 carries this voltage from connection point 32*a* and 32*b* to the LEDs 12*a*, 12*b*, and the resistor 16. The resistor 116 is positioned first in series and in one embodiment the resistors is 35 ohms and the LEDs emit red light. After illuminating the LEDs, the 7.5 volts is carried to output 54 and on to connection points 32*b* and 32*c*.

Figure 5:
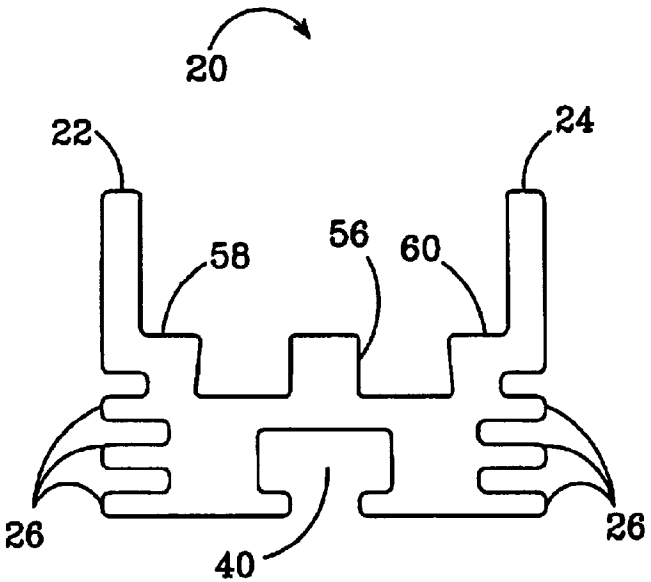
FIG. 5 is an elevation view of the extrusion for the channel lighting unit of FIG. 1.

FIG. 5 shows an elevation view of the extrusion 20. The circuit board 18 (not shown) rests horizontally between the vertical strips 22, 24, on the horizontal surfaces presented by the central longitudinal plateau 56 and the two opposing shelves 58 and 60, all of which are at the same height. The extrusion has horizontal fins 26 running the length of both sides to disperse heat as described above. The extrusion 20 also has a bottom longitudinal cavity 40 for housing the output cables when they are folded under the extrusion 20,as described above. When the lighting units are installed in a channel letter, they can be connected in a daisy chain to match the shape of the channel letter. The cover is removed from the double-sided tape 38 on the back of each unit 10 and the daisy chain is mounted within the channel letter housing. The first unit in the daisy chain is connected to a power supply and all of the LEDs in the chain are illuminated when the power supply provides power. The translucent lens is then placed over the opening or the channel letter housing. Alternatively, the units 10 can be mounted within the channel letter individually after removing the cover from the double-sided tape 38. Each of the units 10 can then be connected to the next one in the daisy chain with the first unit 10 connected to a power supply. When the units with two LEDs are connected, they are arranged on four-inch centers. However, because the input and output wires are flexible, they can be bent so that the channel lighting units can be closer to one another. These adjustments can be made when the brighter lighting is desired.

Figure 7:
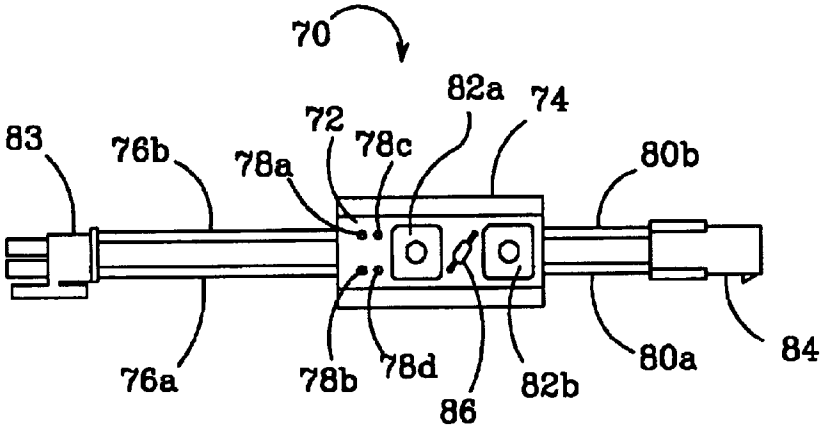
FIG. 7 is a plan view of the channel lighting unit of FIG. 6.
Figure 8:
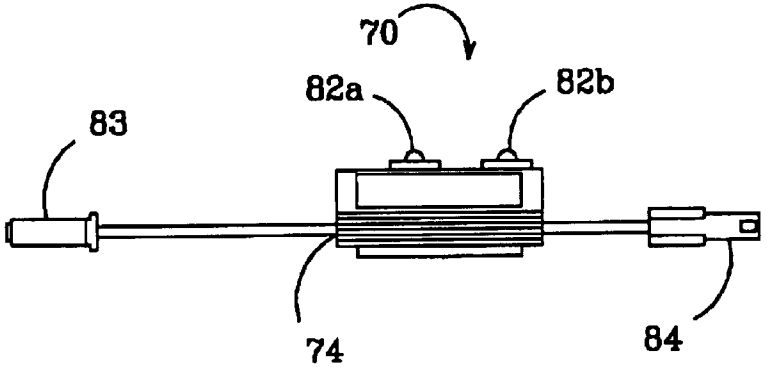
FIG. 8 is an elevation view of the channel lighting unit of FIG. 6.
Figure 6:
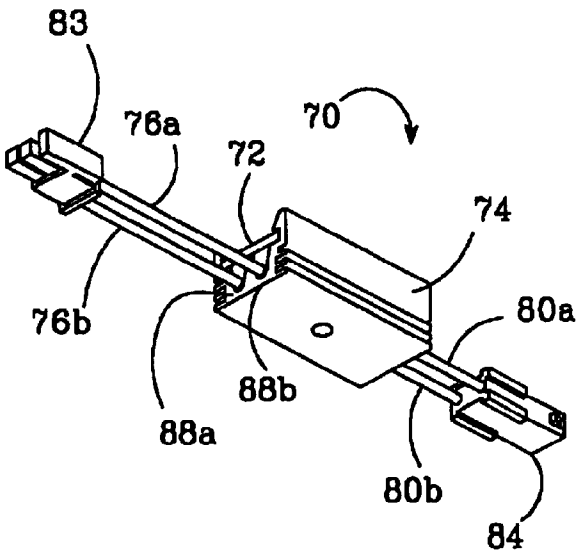
FIG. 6 is a bottom perspective view of another embodiment of a channel lighting unit in accordance with the present invention.

FIGS. 6, 7 and 8 show another embodiment of a channel lighting unit 70 according to the present invention that also has a PCB 72 mounted within an extrusion 74. It also has input wires 76*a*, 76*b* that are connected to the PCB 72 at input connection points 78*a*, 78*b*. Output wires 80*a*, 80*b* are connected to output connection points 78*c*, 78*d* that are adjacent to connection points 78*a*, 78*b*, to minimize line loss as described above in reference to FIG. 3. Two LEDs 82*a*, 82*b*, and a resistor 86 are mounted on the PCB 72, although a different number of LEDs and passive components can be used. Traces are included on the PCB 72 to interconnect the LEDs 82*a*, 82*b*, and resistor 86 in a similar way as the LEDs 12, 14 and resistor 16 as shown in FIG. 4. The unit 70 also has a male connector 83 coupled to the end of input lines 76*a*, 76*b*, and a female connector 84 connected to the end of output lines 20*a*, 20*b*.

Figure 9:
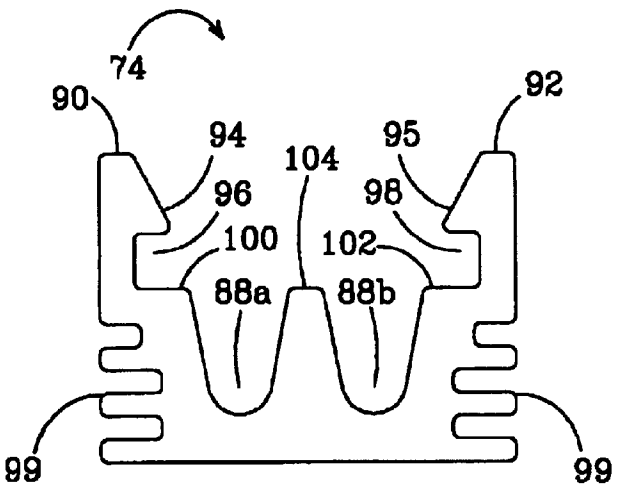
FIG. 9 is an elevation view of the extrusion for the channel lighting unit of FIG. 6.

FIG. 9 is an end elevation view of the extrusion 74 (without PCB 72) used in the unit 70. It does not have a bottom longitudinal cavity for housing the output wires 80*a*, 80*b*, as shown in the embodiment in FIG. 5. Instead, the output wires 80*a* and 80*b* pass under the PCB through channels 88*a*, 88*b*. The extrusion has vertical strips 90, 92 that are similar to strips 22 and 24 in FIG. 5, but have tabs 94, 95, respectively, running their length to form the slots 96, 98 between the tabs 94, 95 and the opposing shelves 100, 102, respectively. A central longitudinal plateau 104 is included so that the PCB 72 is mounted in slots in on 96, 98 and on the central plateau 104. The extrusion also has fins 99 formed below where the PCB 72 would be mounted, with the fins helping to dissipate heat from the PCB's LEDs 82*a*, 82*b*.

Referring again to FIGS. 6 and 7, when the PCB 72 is mounted in the extrusion 74 the input wires 76*a*, 76*b* enter channels 88*a*, 88*b* respectively, and connect to connection points 78*a*, 78*b*. The output wires connect to points 78*c*, 78*d* and pass under the PCT 72 in the channels 88*a*, 88*b*, respectively. The output wires 80*a*, 80*b* extend from the extrusion 74 from the opposite side of the input wires 76*a*, 76*b*, so that the units can be daisy chained with other units.

Figures 10, 11, 14:
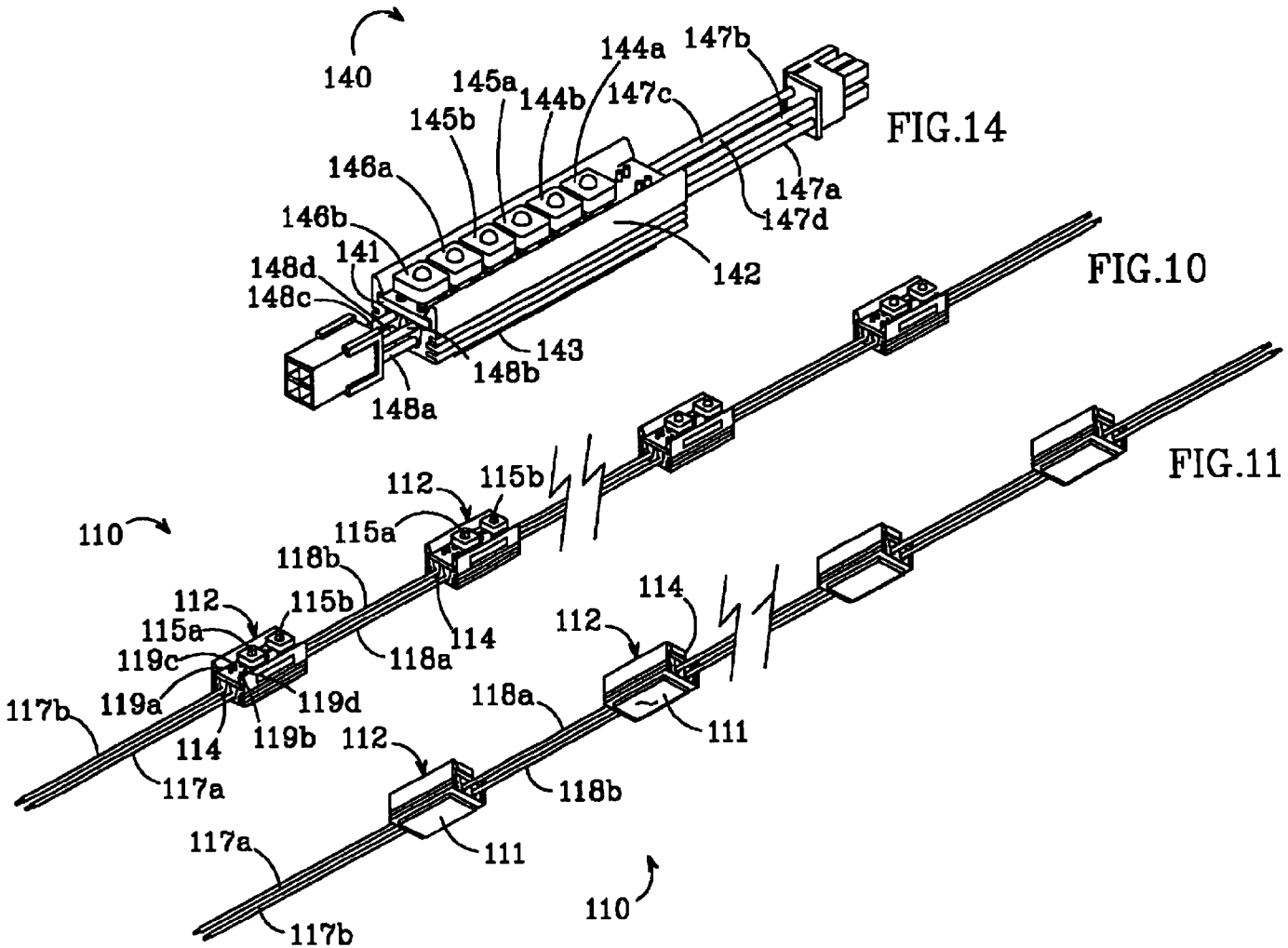
FIG. 10 is a top perspective view of an embodiment of a continuous chain of channel lighting units according to the present invention.
FIG. 11 is a bottom perspective view of the channel lighting units of FIG. 10.
FIG. 14 is a top perspective view of another embodiment of a six LED channel lighting unit according to the present invention.

FIGS. 10 and 11 show an embodiment of a continuous chain 110 of LED units 112. Each of the units 112 is similar to unit 70 in FIGS. 6 and 7, and each has a PCB 114 two LEDs 115*a*, 115*b*, with the PCB 114 mounted in an extrusion 116. Each unit also has input wires 117*a*, 117*b* and output wires 118*a*, 118*b* that are connected to adjacent input connection points 119*a*, 119*b* and output connection points 119*c*, 119*d*, respectively. The output wires 118*a*, 118*b* pass under each unit's PCB through the extrusion channels and pass directly to the input connection points of the next unit in the chain. Each of the units 112 also have a section of double sided tape to mount the units on the inside surface of a channel letter. The chain can be cut to match the length of a channel letter and branches in the chain can be hard wired to the wires between the units. The continuous chain 110 is less expensive than a chain made of units with connectors, but is more difficult to create a chain that matches a particular letter. All of the channel lighting unit embodiments discussed herein can be formed in a continuous chain of units.

Red LEDs are available with relatively high luminous flux, so two LEDs per unit can provide sufficient illumination. Other colors of conventional LEDs such as blue, green and white, provide lower luminous flux or high luminous flux LEDs in these colors can be prohibitively expensive. Accordingly, more LEDs may be needed per channel lighting unit for the low flux LEDs.

Figure 12:
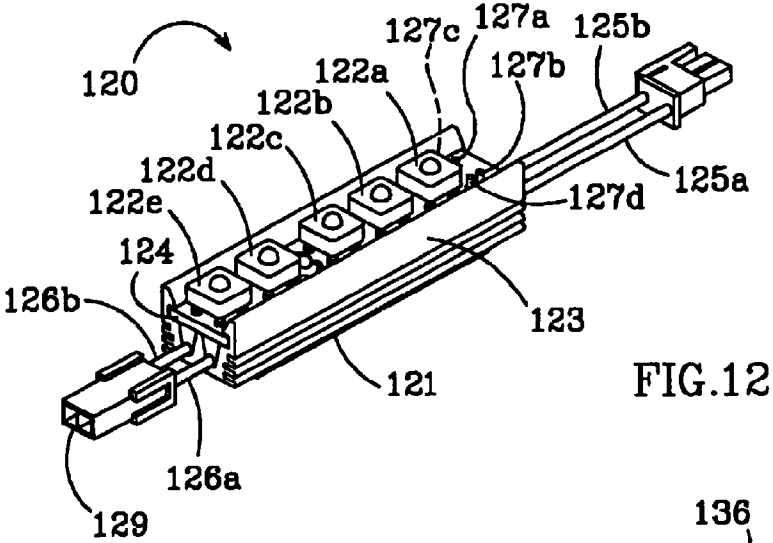
FIG. 12 is a top perspective view of an embodiment of a five LED channel lighting unit according to the present invention.

FIG. 12 shows an embodiment of a channel lighting unit 120 according to the present invention that is particularly adapted to LEDs that have lower luminous flux. Each unit has five linear mounted LEDs 122*a*–*e* on a PCB 124 that is longer than the PCBs in the embodiments above, to accommodate the additional LEDs. The extrusion 123 is similar to the extrusion 74 in FIGS. 6–10 but is longer to match the longer PCB 124. The extrusion 123 also has double sided tape 121 for mounting to the channel letter, although other mounting methods can be used. The input wire 125*a*, 125*b* and output wires 126*a*, 126*b* are also connected to the PCB 124 at connection points 127*a–d*, in the same way as the units above (connection point 127*c* is hidden behind LED 122*a*). The unit 120 has male and female connectors 128, 129. More or fewer LEDs can be included on PCB's in the units 120 according to the present invention and units can be daisy-chained or arranged in a continuous chain.

Figure 13:
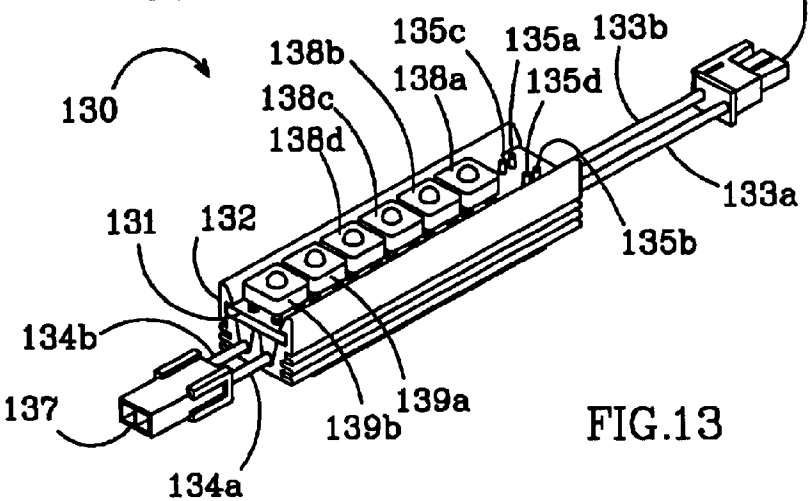
FIG. 13 is a top perspective view of an embodiment of a six LED channel lighting unit according to the present invention.

FIG. 13 shows an embodiment of a channel lighting unit 130 similar to the LED 120 that is particularly adapted to combining LEDs emitting different wavelengths/colors to produce another wavelength/color. The unit 130 has a PCB 131 that is mounted in an extrusion 132 with input wire 133*a*, 133*b* and output wires 134*a*, 134*b* connected to input connection points 135*a–d*. Male and female connectors 136, 137 are connected to the input wires 133*a*, 133*b* and output wires 134*a*, 134*b*, respectively. The output wires 134*a*, 134*b* are folded under the PCB 131 in the extrusion channels. The PDB 131 has four amber LEDs 138*a–c* and two green LEDs 139*a*, 139*b* that can be mounted in different order on the PCB 131. When the unit 130 is mounted in a channel letter with a yellow cover lens, a desirable shade of yellow is produced. This arrangement can be used to combine the color of many different LED colors to produce other desirable colors that are not easily produced by a single LED, such as turquoise and purple.

FIG. 14 shows an embodiment of a six LED channel lighting unit 140 according to the present invention wherein the six LEDs comprise groups of different colored LEDs that can be illuminated individually or with other of the groups. The unit comprises a PCB 141 and an extrusion 142 with double-sided tape 143 on the extrusion's bottom surface. The PCB includes two red LEDs 144*a*, 144*b*, two green LEDs 145*a*, 145*b* and two blue LEDs 146*a*, 146*b*, although the PCB 141 can have different colors with different numbers of LEDs in each group of colors. The unit 140 has four input wires 147*a–c*, which comprise three power wires, and one return wire. The output wires 148*a–c* also comprise the same three power wires and one return wire. Each of the three power wires can separately provide power to a respective color group of LEDs. This allows the red LEDs 144*a*, 144*b*, green LEDs 145*a*, 145*b* and blue LEDs 146*a*, 146*b* to be activated separately or in combination by supplying power to the appropriate power wires, which allows the unit to illuminate in red, green or blue, or combinations thereof.

Figure 15:
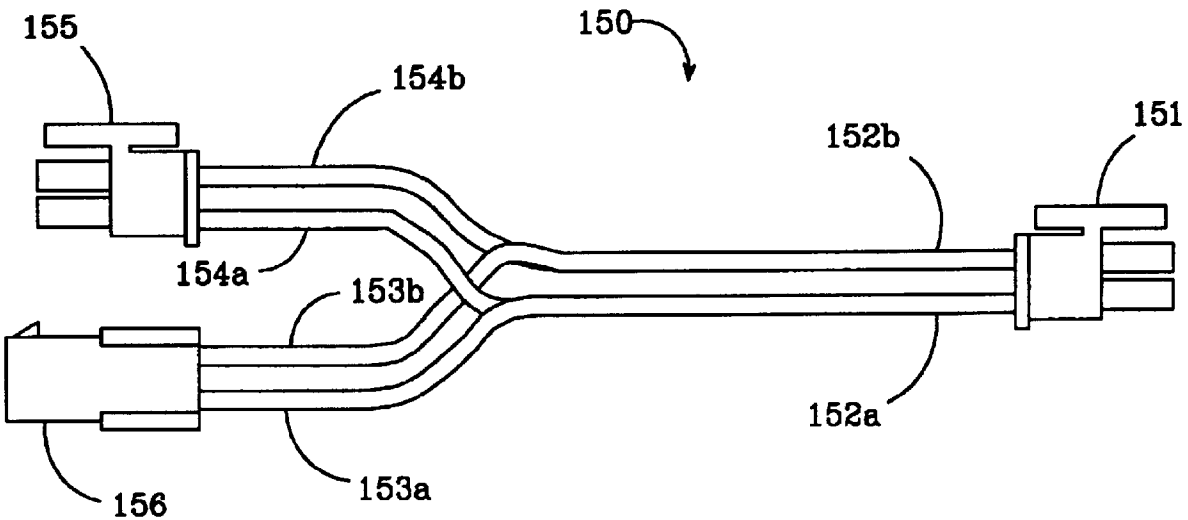
FIG. 15 is an embodiment of a Y connector according to the present invention.

FIG. 15 shows an embodiment of a Y connector 150 according to the present invention that is used to branch the units described above that have male and female connectors. The Y connector 150 has a male connector 151 that is connected to wires 152*a*, 152*b*, that branch into wires 153*a*, 153*b* and 154*a*, 154*b*. A second male connector 155 is coupled to wires 153*a*, 153*b*, and a female connector 156 is coupled to wires 154*a*, 154*b*, although other connector arrangements can be used. The male and female connectors 151, 155, 156 are connected to channel letter units and in one embodiment, the signal from the unit attached to male connector 151 is branched into the units attached to male and female connectors 155, 156. In a further embodiment according to the invention with the signal going the opposite direction, the signal from the units attached to male and female connectors 155, 156, is applied to the unit attached to male connector 151. Y connectors according to the present invention can have different connectors on the wires, can branch into a different number of branches and can be arranged to branch the four-wire embodiment shown in FIG. 14.

Figure 16:
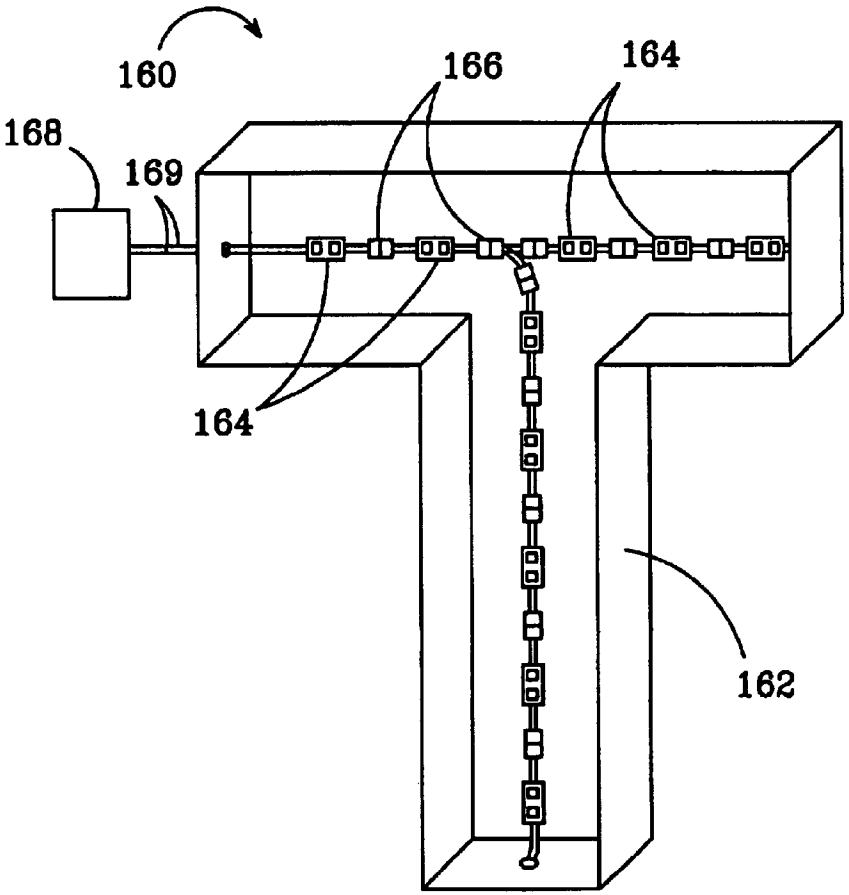
FIG. 16 is a perspective view of an embodiment of a channel letter according to the present invention.

FIG. 16 shows an embodiment of a channel letter system 160 according to the present invention that can use any of the channel lighting units according to the invention. The system 160 comprises a channel letter housing 162 and channel lighting units 164 mounted to the bottom surface 166 of the channel letter 160. The lighting units 164 can be used in different sized channel letters and are particularly adapted to being mounted in channel letters where the lighting unit's LEDs are between 3 to 6" from the channel letter face lens. The lighting units 164 are connected in a series at connectors 166 in a daisy chain. The daisy chained lighting units 164 are designed to give even light without hot spots, with the light output being comparable to neon when the channel letter is viewed with its face lens on. Different color LEDs are available including red, amber, yellow green, blue and white. The channel lighting system 160 uses a simple 7.5V DC power supply 168 and in one embodiment, the power signal is coupled to the lighting units 164 through power wires 169 that pass through housing holes to the first lighting unit in the daisy-chain.

The lighting unit is small and compact enough to fit into tight spaces such as small letters or serifs. The unit's wire and connector system is simple, robust and provides flexibility in the length of a daisy chain and where it branches. The use of LEDs with high luminous flux reduces the number of LEDs required for proper illumination.

Although the present invention has been described in considerable detail with reference to certain preferred configurations thereof, other versions are possible. Lighting units according to the invention can be used for many different applications beyond channel letters. A separate power supply can be used for each channel letter or multiple letters can be powered by a single power supply. In other embodiments, a variable power supply can be used to control the intensity of the light emitters. The lighting unit can be many different sizes and can be used in many different applications beyond channel letters. The PCB can have different numbers of LEDs and can have different electronic components arranged in different ways. The extrusions can take different shapes and can have additional strictures to help transfer heat away from the unit. The wires can be different lengths and can have different connectors. Therefore, the spirit and scope of the invention and the following claims should not be limited to the preferred versions described above.

We claim:

1. A channel letter lighting unit, comprising:

a printed circuit board (PCB) having a plurality of linearly mounted light emitting elements;

input wires to transmit a power signal to said PCB to illuminate said plurality of light emitting elements;

output wires to transmit said power signal from said PCB such that said lighting unit can be connected in a daisy-chain with other units;

a thermally conductive extrusion, said PCB mounted to said extrusion with said light emitting elements transmitting light away from said extrusion, said extrusion conducting and dissipating heat from said light emitting elements; and a mounting mechanism for mounting said extrusion within a housing.

2. The unit of claim 1, wherein said extrusion has fins to dissipate heat from said light emitting elements.

3. The unit of claim 1, wherein each of said plurality of light emitting elements is a light emitting diodes (LED).

4. The unit of claim 1, wherein said plurality of light emitting elements comprises two red LEDs.

5. The unit of claim 1, wherein said PCB is mounted to said extrusion with a thermally conductive material, which holds said PCE to said extrusion and conducts heat from said PCB to said extrusion.

6. The unit of claim 1, said PCB further comprising connection points for said input and output wires, said input wire connection points adjacent to said output wire connection points to reduce transmission loss.

7. A channel letter lighting unit, comprising:

a printed circuit board (PCB) having a plurality of linearly mounted light emitting elements;

input wires to transmit a power signal to said PCB to illuminate said plurality of light emitting elements;

a thermally conductive extrusion, said PCB mounted to said extrusion with said light emitting elements transmitting light away from said extrusion, said extrusion conducting and dissipating heat from said light emitting elements; and a mounting mechanism for mounting said extrusion within a housing, further comprising output wires to transmit said power signal from said PCB and, further comprising a power input connector on the end of said input wires opposite said PCB and output connector on the end of said output wires opposite said PCB.

8. The unit of claim 7, wherein said plurality of light emitting elements emit different wavelengths of light that combine to create another wavelength of light.

9. The unit of claim 7, wherein said plurality of light emitting elements comprises one or more amber LEDs and one or more green LEDs.

10. The unit of claim 7, wherein said plurality of light emitting elements comprises LEDs emitting at different wavelengths of light, said unit capable of emitting each said different wavelength alone or in combination with other wavelengths of light.

11. The unit of claim 7, wherein said plurality of light emitting elements comprises one or more red LEDs, one or more blue LEDs, one or more green LEDs, each of which emits light alone or in combination with others.

12. The unit of claim 7, wherein said mounting mechanism comprises double sided tape.

13. The unit of claim 7, wherein said input and output connectors extend in opposite directions from said unit.

14. A lighting system, comprising:

a plurality of lighting units electrically connected to one another so that a power signal applied to the lighting system is transmitted to each of said plurality of lighting units, each of said units comprising;

a plurality of linearly mounted light emitting elements;

input wires to transmit said power signal to and illuminate said plurality of light emitting elements, said input wires capable of receiving said power signal from another of said plurality of lighting elements;

output wires to transmit said power signal from said plurality of light emitting elements said output wires capable of transmitting said power signal to another of said plurality of lighting units such that said units can be connected in a daisy-chain with other units;

an extrusion, said light emitting elements mounted to said extrusion, said light emitting elements transmitting light away from said extrusion, said extrusion also promoting dissipation of heat from said light emitting elements; and a mounting mechanism on each of said plurality of units, for mounting said extrusion within a housing.

15. The system of claim 14, further comprising a printed circuit board (PCB), said light emitting elements mounted to said PCB, and said input and output wires connected to said PCB, said PCB mounted to said extrusion.

16. The system of claim 14, further comprising Y connectors to provide branches in the interconnection of said plurality of lighting units.

17. The system of claim 14, wherein said extrusion is made of a rigid and heat conductive material, said extrusion conducting and dissipating heat from said light emitting elements.

18. The system of claim 14, wherein said extrusion has fins to dissipate heat from said light emitting elements.

19. The system of claim 14, wherein each of said plurality of light emitting elements is a light emitting diodes (LED).

20. The system of claim 14, wherein said plurality of light emitting elements on each of said plurality of lighting units emit different wavelengths of light that combine to create another wavelength of light.

21. The system of claim 15, said PCB further comprising connection points for said input and output wires, said input wire connection points adjacent to said output wire connection points to reduce transmission loss.

22. A lighting system, comprising:

a plurality of lighting units electrically connected to one another so that a power signal applied to the lighting system is transmitted to each of said plurality of lighting units, each of said units comprising;

a plurality of linearly mounted light emitting elements;

input wires to transmit said power signal to and illuminate said plurality of light emitting elements, said input wires capable of receiving said power signal from another of said plurality of lighting elements;

output wires to transmit said power signal from said plurality of light emitting elements said output wires capable of transmitting said power signal to another of said plurality of lighting units;

an extrusion, said light emitting elements mounted to said extrusion, said light emitting elements transmitting light away from said extrusion, said extrusion also promoting dissipation of heat from said light emitting elements; and a mounting mechanism on each of said plurality of units for mounting said extrusion within a housing, each of said units further comprising a printed circuit board (PCB), said light emitting elements mounted to said PCB, and said input and output wires connected to said PCB, said PCB mounted to said extrusion, further comprising a power input connector on the end of said input wires opposite said PCB and output connector on the end of said output wires opposite said PCB, said connectors connectable to connectors on others of said plurality of units, said plurality of units connected in a daisy-chain.

23. The system of claim 22, wherein said plurality of light emitting elements on each of said plurality of lighting units comprises one or more amber LEDs and one or more green LEDs.

24. The system of claim 22, wherein said plurality of light emitting elements on each of said plurality of lighting units comprises LEDs emitting at different wavelengths of light, said unit capable of emitting each said different wavelength alone or in combination with other wavelengths of light.

25. The system of claim 22, wherein said plurality of light emitting elements on each of said plurality of lighting units comprises one or more red LEDs, one or more blue LEDs, and one or more green LEDs, each of which emits alone or in combination with others.

26. The system of claim 22, wherein said plurality of light emitting elements on each of said plurality of lighting units comprises two red LEDs.

* * * * *

UNITED STATES PATENT AND TRADEMARK OFFICE

CERTIFICATE OF CORRECTION

PATENT NO. : 6,932,495 B2
DATED : August 23, 2005
INVENTOR(S) : Thomas C. Sloan and Bruce Quaal It is certified that error appears in the above-identified patent and that said Letters Patent is hereby corrected as shown below:

Column 4,
Line 62, change “LEDs 12,14” to -- LEDs 12a, 12b --;

Column 6,
Line 8, change “20a,20b” to -- 80a,80b --;

Column 9,
Line 3, change “PCE” to -- PCB --;
Line 53, insert a comma after “elements”;

Column 10,
Line 30, insert a comma after “elements”.

Signed and Sealed this

Third Day of January, 2006

JON W. DUDAS
*Director of the United States Patent and Trademark Office*